United States Patent [19]

Jensen

[11] 4,181,596

[45] Jan. 1, 1980

[54] PROCESS FOR TREATING HOT SHALE OIL EFFLUENT FROM A RETORT

[75] Inventor: Harbo P. Jensen, San Rafael, Calif.

[73] Assignee: Chevron Research Company, San Francisco, Calif.

[21] Appl. No.: 891,425

[22] Filed: Mar. 29, 1978

[51] Int. Cl.[2] ..... C10G 1/00; C10G 31/06

[52] U.S. Cl. ..... 208/11 R; 208/251 R

[58] Field of Search ..... 208/11 R, 251

[56] References Cited

U.S. PATENT DOCUMENTS

| | | | |
|---|---|---|---|
| B 438,916 | 1/1976 | Rosynek et al. | 208/253 |
| 2,778,779 | 1/1957 | Donaldson | 196/50 |
| 2,910,434 | 10/1959 | Hess et al. | 208/251 |
| 3,284,336 | 11/1966 | Culbertson et al. | 208/11 |
| 3,523,071 | 8/1970 | Knapp et al. | 208/14 |
| 3,532,618 | 10/1970 | Wunderlich et al. | 208/14 |
| 3,738,931 | 6/1973 | Frankovich et al. | 208/67 |
| 3,876,533 | 4/1975 | Myer | 208/251 H |
| 3,933,624 | 1/1976 | Myer | 208/253 |
| 3,947,374 | 3/1976 | Loffelman | 252/102 |
| 3,954,603 | 5/1976 | Curtin | 208/253 |
| 4,003,829 | 1/1977 | Burger et al. | 208/253 |
| 4,029,571 | 6/1977 | Curtin | 208/251 H |
| 4,051,022 | 9/1977 | Myer et al. | 208/253 |

*Primary Examiner*—Delbert E. Gantz
*Assistant Examiner*—William G. Wright
*Attorney, Agent, or Firm*—D. A. Newell; R. H. Davies; M. K. Bosworth

[57] ABSTRACT

Oil shale retort effluent having a temperature of at least 650° F. (343° C.) is cooled, if necessary, to within the range from 600°-800° F. (316°-427° C.), separated into a liquid phase and a vapor phase, and the liquid phase is maintained within that range for 1 to 120 minutes to form a liquid product having a pour point less than 40° F. (4.4° C.). When the effluent contains at least one contaminant selected from soluble iron and soluble arsenic and is withdrawn from the retort at a temperature of at least 300° F. (149° C.), maintaining the liquid phase at a temperature from 300°-800° F. (149°-427° C.) will cause formation of (1) a precipitate containing iron, arsenic or both and (2) a liquid product having a reduced contaminant content.

9 Claims, No Drawings

PROCESS FOR TREATING HOT SHALE OIL EFFLUENT FROM A RETORT

BACKGROUND OF THE INVENTION

This invention relates to a process for the treatment of shale oil effluent from an oil shale retort. More particularly, this invention relates to a process for treating the shale oil effluent to lower the pour point, to reduce the content of contaminants such as soluble iron and soluble arsenic, or both of these.

The shale oil produced by conventional retorting processes has a number of characteristics which make it difficult to transport and subsequently refine. Among these detrimental characteristics, one of the most bothersome is the high pour point of the product shale oil, which makes handling at ambient temperatures difficult in the retort oil recovery system. Furthermore, any subsequent transportation of shale oil from the retorting site to a refinery site is hampered because of the poor flow characteristics of these high-pour-point oils. Typical pour points of shale oils from existing retorting processes are generally above 40° F. and usually in the range of 65° to 85° F., yet for satisfactory transportation by pipeline or tanker, the pour point should be lower than 40° F. In the United States, large shale oil deposits are located in areas where temperatures during a good portion of the year are below 40° F. and are often below freezing (32° F.). A simple, economical process for reducing the pour point has long been desired.

Another detrimental characteristic of shale oils is that they contain contaminants which affect their ability to be readily processed into fuels or precursors for the synthesis of other desired materials. Shale oils contain contaminants such as arsenic and iron which tend to interfere with refining and conversion processes such as hydrogenation, cracking and reforming. In many instances, these contaminants will poison or inactivate catalysts used in such processes, and therefore, should be wholly or at least partially removed. Even if the shale oil is used directly as a fuel, the removal of such contaminants may be desirable from an environmental protection standpoint. A simple economical process for removing those contaminants or reducing them to low concentrations in the shale oil has long been desired.

DESCRIPTION OF THE PRIOR ART

Prior art processes for treating shale oil do not disclose a process integrating retorting of the oil shale with thermally treating the shale oil effluent as it is being cooled. Instead, they heat a shale oil already at ambient temperature.

U.S. Pat. No. 3,284,336 and U.K. Pat. No. 995,106 disclose a process for reducing the pour point of shale oil by separating shale oil into light and heavy fractions, thermally treating the heavy fraction, and recombining both fractions. U.S. Pat. No. 3,738,931 discloses hydrovisbreaking shale oil, followed by hydrogenating the vaporized visbroken oil and recombining the vapors with unvaporized oil to obtain a shale oil having a reduced pour point. U.S. Pat. No. 3,523,071 describes visbreaking and fractionating a shale oil, with the higher boiling fraction of the visbroken shale oil being combined with a portion of unvisbroken shale oil to obtain a low-pour-point product. U.S. Pat. No. 3,532,618 describes hydrovisbreaking shale oil to obtain a low-pour-point product. These references do not discuss an integrated process for producing a shale oil having a low pour point. They also do not discuss producing a shale oil having a reduced content of such contaminants as soluble arsenic and soluble iron.

Heretofore, one way in which arsenic has been removed from hydrocarbon charge stocks is by contacting the charge stock with oxides of iron, cobalt or nickel and substantial amounts of water at a low temperature, as is disclosed in U.S. Pat. No. 2,778,799. The metal oxide oxidizes the arsenic to a water-soluble arsenic oxide. The arsenic oxide is dissolved by the water and removed from the hydrocarbon. Also, arsenic has been removed from raw shale oil by contacting the shale oil in the absence of water with a catalyst such as oxide or sulfide compounds of iron, cobalt or nickel at an elevated temperature under hydrogen pressure, see for instance U.S. Pat. Nos. 3,876,533; 3,933,624; 3,954,603; 4,003,829 and 4,051,022.

U.S. Pat. No. 4,029,571 discloses a method for heat treating shale oil, either in the presence or the absence of hydrogen, to form an arsenic-containing precipitate which is suspended in the oil and must be subsequently separated. Although the method of this reference can produce a treated oil having reduced levels of arsenic and selenium contaminants, and a reduced pour point when hydrovisbreaking is employed, this reference repeatedly discloses only heating of the feedstock, and it does not anywhere suggest integrating the thermal treating step with cooling of the effluent from the retort or with the retorting step itself.

In other uses, a thermal treating step has been employed to remove various metallic contaminants from petroleum hydrocarbons, as has been described in U.S. Pat No. 2,910,434. This reference discloses removal of up to 26 various trace metals, but not arsenic, from a petroleum crude oil feed by non-catalytically reacting the feed with hydrogen in the presence of an inert packing material to form a treated oil of reduced metal content and a solid metal-containing residue. U.S. Pat. No. 3,947,347 discloses removal of the same metals from a hydrocarbon feed by contacting the feed with hydrogen and an inert packing material having a specified pore diameter range to deposit the contaminants on the inert material. U.S. Pat. No. B438,916 discloses demetallation (nickel, vanadium, iron, copper, zinc or sodium, but not arsenic) of a residual petroleum fraction by contacting the oil with a refractory oxide in the absence of added hydrogen. These references do not concern arsenic removal or pour point reduction, and they fail to recognize that the thermal treatment can be integrated with retorting of oil shale, with a resulting savings in energy which would ordinarily be required to keep the shale oil above its pour point and to reheat the shale oil for thermal treating.

SUMMARY OF THE INVENTION

I have discovered an economical method, integrated with an oil shale retorting process, for treating shale oil to reduce the pour point, contaminant content, or both. Broadly stated, shale oil effluent from an oil shale retort is maintained within a certain temperature range to reduce the pour point, contaminant content, or both.

In accordance with one embodiment employed in a process for producing shale oil in which oil shale is retorted in a retorting zone to form a shale oil effluent, and the effluent is withdrawn from the zone at a first temperature of at least 650° F. (343° C.), the present invention relates to an improved method for forming from the effluent a liquid product having a desirably low pour point which comprises:

(a) cooling the effluent to a second, lower, temperature within the range from 600°-800° F. (316°-427° C.);

(b) separating the effluent into a liquid phase and a vapor phase;

(c) lowering the pour point of the liquid phase to less than 40° F. (4.4° C.) by maintaining the liquid phase within that temperature range for 1 to 120 minutes, thereby forming the liquid product.

In accordance with a preferred embodiment of the present invention, said cooling in step (b) comprises quenching said effluent with a quench stream.

In accordance with another preferred embodiment of the present invention, the oil shale contains at least one of iron and arsenic, the shale oil effluent contains at least one contaminant selected from soluble iron and soluble arsenic, a precipitate containing at least one of iron and arsenic is formed in step (c), and the product has a reduced contaminant content.

In accordance with another embodiment employed in a process for producing shale oil in which oil shale is retorted in a retorting zone to form a shale oil effluent, and said effluent is withdrawn from said zone at a temperature in the range from 600°-800° F. (316°-427° C.), the present invention relates to an improved method for forming from said effluent a liquid product having a desirably low pour point which comprises (a) separating said effluent into a liquid phase and a vapor phase and (b) lowering the pour point of said liquid phase to less than 40° F. (4.4° C.) by maintaining said liquid phase within said temperature range for 1 to 120 minutes, thereby forming said liquid product.

In accordance with still another embodiment employed in a process for producing shale oil in which an oil shale containing at least one of iron and arsenic is retorted in a retorting zone to form a shale oil effluent containing at least one contaminant selected from soluble iron and soluble arsenic, and said effluent is withdrawn from said zone at a temperature in the range from 300°-800° F. (149°-427° C.), the present invention relates to an improved method of forming from said effluent a liquid product having a reduced contaminant content which comprises (a) separating said effluent into a liquid phase and a vapor phase and (b) reducing the contaminant content of said liquid phase by maintaining said liquid phase within said temperature range for 1 to 120 minutes, thereby forming said liquid product and a precipitate containing at least one of iron and arsenic.

DETAILED DESCRIPTION OF THE INVENTION AND PREFERRED EMBODIMENTS

The present invention is applicable to treating the effluent from an oil shale retorting process. As used herein, the term "oil shale" means sedimentary rocks containing kerogen, regardless of their common or scientific designations, which upon destructive distillation, yield a mixture of hydrocarbons and other compounds usually called "shale oil". These sedimentary rocks almost always contain arsenic compounds, and frequently also iron compounds. Extensive deposits of arsenic-containing oil shale are found in this country, particularly in Colorado, Utah and Wyoming, and deposits of varying extent and richness are found in other countries throughout the world. The oil shale feedstock is retorted in a retorting zone by known methods to provide a shale oil vapor which usually contains iron and arsenic. The shale oil effluent, generally in vapor or mist form, is withdrawn from said zone at an elevated temperature for treatment by the improved method of the present invention.

The retorting which forms a part of the process of the present invention is carried out by the destructive distillation of naturally-occurring oil shale at temperatures which usually range from 800° to 1300° F. (427° to 704° C.). The retorting may be carried in suitable in situ or above-ground shale oil retorting processes, for example, the U.S. Bureau of Mines process, the Union Oil Company of California process, or the Tosco retorting process. Further examples of suitable oil shale retorting processes may be found in the Kirk-Othmer Encyclopedia of Chemical Technology, 2nd Edition, by John Wiley & Sons, New York, New York, 1969, and in Oil From Shale And Tar Sands by Edward M. Perrini, published by Noyes Data Corporation, Park Ridge, New Jersey, 1975.

The pour-point reduction achieved by the present process occurs regardless of the amount of contaminant in the shale oil effluent. When the shale oil effluent contains arsenic, it will generally contain more than 8 parts per million by weight arsenic, usually more than 13 ppmw and frequently from 20 to 100 ppmw or more. The arsenic is usually in soluble form, but some may be in suspension in the effluent. The shale oil effluent may also contain iron, generally at least 10 ppmw, and frequently from 30 to 500 ppmw. The iron will usually be in soluble form, but some may be present in the effluent as a suspension.

The term "arsenic" includes compounds and ions of arsenic, while "soluble arsenic" includes only those compounds and ions which are soluble in shale oil. The term "iron" includes compounds and ions of iron, while "soluble iron" includes only those compounds and ions which are soluble in shale oil.

In one embodiment of the present invention, the shale oil effluent, after being withdrawn from the retort at a temperature of at least 650° F. (343° C.), and preferably over 800° F. (427° C.), is then cooled to a lower temperature within the range of 600°-800° F. (316°-427° C.), and preferably within the temperature range of 700°-750° F. (371°-399° C.). The effluent is preferably cooled to a temperature which is below the point of significant thermal decomposition, i.e., at which substantially no cracking of the oil will occur and substantially no carbon, methane or ethane gases will be formed. "Substantially no methane or ethane gases" means less than 1 or 2 weight percent of the oil of either gas will be formed.

In accordance with the method of the present invention, the cooling, when used, may be accomplished by either direct heat exchange means (such as quenching with a shale oil or other hydrocarbon stream), or by indirect heat-exchange means (such as conventional heat exchangers). In a preferred embodiment of this invention, at least a portion of the product is cooled, and cooling of the effluent is carried out by quenching the effluent with the cooled portion of the product. According to this embodiment, either the entire product may be cooled and a portion of the cooled product used to quench the effluent, or a portion of the product may be cooled and this cooled portion used to quench the effluent. Of course, in this latter instance, the remaining product may be separately cooled before it is sent for storage or subsequent processing or handling.

In other embodiments it is not necessary to cool the effluent before it is separated into a liquid phase and a vapor phase.

In any event, the effluent should be separated into a liquid phase and a vapor phase, either concurrent with or subsequent to the cooling of the effluent. Both the liquid and vapor phases may be passed through the temperature maintenance zone, or the vapor phase may be removed from contact with the liquid phase prior to the thermal maintenance step. In the latter case, the vapor phase may be recombined with the resulting liquid product. In many cases, when the effluent is cooled prior to being separated into a liquid phase and a vapor phase, the cooled effluent will be in the form of a mist. To separate the mist into separate liquid and vapor phases, it may be necessary to use separation equipment known to the art. Examples of such separation equipment include oil washes such as an oil absorber, demister pads, electrostatic and sonic precipitators or any separator or liquid scrubber suitable for removing finely divided liquid particles from a gas stream. It is consistent with the scope of this invention for provision to be made for removing any fines contained in the shale oil effluent during any step of the present process.

When the effluent is cooled by quenching, which is a preferred embodiment of the present invention, such separation equipment may not be necessary, because some methods of injecting quench oil into the effluent effect the desired separation into a liquid phase and a vapor phase. Both the liquid and vapor phases may be charged to the temperature maintenance zone, but it is only necessary for the liquid phase to remain within the specified temperature range for the required time.

When the oil is cooled to within the range of 600°-800° F. (316°-427° C.) or recovered from the retort within that range, the liquid phase is maintained within that range for a time sufficient to effect reduction of the pour point to less than 40° F. (4.4° C.). When the effluent is maintained at a temperature from 300° to 800° F. (149°-427° C.) and sufficient soluble iron or arsenic contaminant is present therein, the time is preferably sufficient to effect formation of contaminant-containing percipitate. The time required to accomplish these effects will be from 1 to 120 minutes, and preferably from 5 to 60 minutes. Generally, the lower the temperature, the longer the time that will be required to effect the optimum reduction.

The temperature maintenance (thermal treatment) of the liquid phase is especially useful when carried out in the presence of a solid contact material, although contact material need not be present. When the temperature maintenance is carried out in the presence of a solid contact material, at least a portion of arsenic-containing precipitate deposits upon the contact material, and the liquid product will contain less total arsenic than the effluent. Total arsenic means the sum of soluble plus insoluble arsenic, calculated as elemental arsenic. When the effluent contains iron as well as arsenic, and the liquid phase is contacted with the contact material, iron-containing precipitate is formed and the product will also contain less total iron, calculated as elemental iron, than the retort effluent. By the process of the present invention, the soluble iron content of the product may be reduced to about half its concentration in the retort effluent, in the absence of added hydrogen, and the soluble arsenic content may be reduced to as low as 8 to 15 ppmw. When both iron and arsenic are present, they will generally precipitate together as iron arsenide.

The contact material comprises any suitable solid which maintains its structural integrity under conditions of the temperature maintenance step whether catalytic with respect to precipitation of the iron or arsenic or not. Examples of suitable contact material include inorganic oxides, spent catalyst, bauxite and carbon. When the term "precipitate" is used herein, it refers to any solid or semi-solid material that is insoluble in and separates from or is capable of being physically separated from the liquid portion of the thermally treated shale oil.

When the temperature maintenance step is carried out in the absence of a contact material and a sufficient amount of soluble iron, soluble arsenic, or both are present in the shale oil effluent, the precipitate will form within the oil as minute suspended particles. The reduction of pour point and lowering of the soluble arsenic content in the absence of a contact material have been described in U.S. Pat. No. 4,029,571. Whether a separation step will be required to remove the suspended precipitate from the product will depend upon the intended use or subsequent treatment of the product. For instance, if the product is to be coked or transported by tanker or pipeline, no precipitate removal need be carried out, but if the product is to be catalytically processed, the precipitate may be separated.

The temperature maintenance step should be carried out at pressure sufficient to keep the liquid portion of effluent in liquid phase. A pressure from atmospheric to that at which the retort is maintained is preferred. The temperature maintenance step may be carried out in an inert atmosphere such as nitrogen or flue gas, or in the presence of hydrogen. While it is recognized that the presence of added hydrogen preferably at a pressure of at least 500 psig will decrease the amount of soluble arsenic which remains in the product to as low as 1 to 3 ppmw, as well as the amount of soluble iron, the difficulty and expense of producing hydrogen at the retort site makes temperature maintenance in the absence of added hydrogen a preferred embodiment.

Holding the liquid phase within the temperature range of 600° to 800° F. (316° to 427° C.) allows a pour point depressant to be formed within the liquid phase. This pour point depressant apparently alters the morphology of wax crystals which form in the oil and thus reduces the pour point of the liquid product to a desirably low pour point, such as below 40° F. However, it is not unusual for the pour point of the shale oil product to be reduced to below 0° F. (−18° C.) or even below −30° F. (−34° C.) by following the method of the present invention.

If both liquid and vapor phases are passed through the temperature maintenance zone, they may be cooled without being separated to yield the product containing a broad-boiling-range shale oil product, or the liquid portion may be cooled separately from the vapor phase to give both high- and low-boiling-range shale oil products. Alternatively, other cooling schemes may be used, such as providing for fractional condensation of the vapor phase. When a shale oil quench is used, according to a preferred embodiment of the present invention, the composition of the quench is not critical and it may comprise gas, oil, or any of the above shale oils or fractions, cooled in any appropriate manner.

The temperature maintenance step of this invention is to be distinguished from visbreaking techniques practiced by the prior art. Visbreaking is a pyrolysis treatment of an oil to destroy waxes and high-molecular-weight constituents therein, thus reducing the viscosity of the oil. In visbreaking, considerable cracking is desired and is obtained along with formation of a substantial amount of coke. In the temperature maintenance step of this invention, however, little if any cracking or coke formation occurs. The paraffin content of shale oil after the pour point reduction by a temperature maintenance step is virtually the same as that of raw shale, indicating that no significant cracking occurs during the temperature maintenance step. In visbreaking, there is a substantial reduction in the amount of high molecular weight paraffins. For a more detailed explanation of the differences in visbreaking and temperature maintenance (thermal treating), see my co-pending application Ser. No. 891,567, entitled "Method For Lowering The Pour Point Of Shale Oil", filed Mar. 29, 1978.

The present invention will be more fully understood by reference to the following example which illustrates a preferred embodiment of the process of the present invention.

EXAMPLE

An arsenic-containing Colorado oil shale is retorted and a vaporous effluent is withdrawn at 950° F. (510° C.) in the following amount and composition: 1.0 lb/hr normally liquid hydrocarbons, 0.3 lb/hr normally gaseous hydrocarbons, water, carbon dioxide, hydrogen sulfide and ammonia, and 0.1 lb/hr carrier (recycle) gas, for a total of 1.4 lbs/hr. The effluent is quenched to 700° F. (371° C.) by injection through an atomizer of 0.65 1 lbs/hr of a quench oil (taken from the product shale oil), thus forming a liquid and a mist.

The mixture is then passed through an electrostatic precipitator to precipitate the liquid from the mist, and the resulting two-phase mixture is charged to a contact zone containing 1000 cc of a contact material. The contact material is made of ¼" diameter extruded diatomaceous earth about ⅜" long. The vapor passes rapidly through the contact zone, but the shale oil liquid has a longer residence time of about one hour (a liquid hourly space velocity of approximately 1). The residence time of the liquid is longer because it travels predominantly along the wetted surface of the contact material.

The effluent from the contact zone is air-cooled to 150° F. (66° C.) and a portion of the liquid in the amount of 0.65 lb/hr is used as the quench oil. After further cooling, the net product per hour has the following composition: 1.0 lb shale oil liquid, 0.3 lb normally gaseous hydrocarbons, $H_2O$, $CO_2$, $H_2S$ and $NH_3$, as well as 0.1 lb. recycle carrier gas. The liquid shale oil product has a pour point of −5° F. (−15° C.), and contains 14 ppmw arsenic. Shale oil effluent recovered by traditional methods from the retort without any temperature maintenance step generally has a pour point in the range of 65° to 85° F. (18° to 29° C.) and an arsenic content in the range of 17 to 40 ppmw. This example shows that the process of the present invention can be integrated with a shale oil retort to produce a shale oil having a desirably low pour point as well as a decreased arsenic content.

What is claimed is:

1. In a process for producing shale oil where oil shale is retorted in a retorting zone to form a shale oil effluent, and said effluent is withdrawn from said zone at a first temperature of at least 650° F. (343° C.), the improved method for forming from said effluent a liquid product having a desirably low pour point which comprises:

(a) cooling said effluent to a second, lower, temperature within the range from 600°-800° F. (316°-427° C.);

(b) separating from said effluent a liquid shale oil phase;

(c) lowering the pour point of said liquid phase to less than 40° F. (4.4° C.) by maintaining said liquid phase within said temperature range and below the point of significant thermal decomposition and in the absence of added hydrogen for 1 to 120 minutes, thereby forming said liquid product.

2. The process of claim 1 wherein said cooling in step (a) comprises quenching said effluent with a quench stream.

3. The process of claim 2 wherein a portion of said product is cooled and said portion is used as said quench stream.

4. The process of claim 1 wherein said oil shale contains at least one of iron and arsenic, said shale oil effluent contains at least one contaminant selected from soluble iron and soluble arsenic, said product has a reduced contaminant content, and in step (c) a precipitate containing at least one of iron and arsenic is formed.

5. The process of claim 4 including conducting step (c) in the presence of a solid contact material and depositing at least a portion of said precipitate upon said material.

6. In a process for producing shale oil where oil shale is retorted in a retorting zone to form a shale oil effluent, and said effluent is withdrawn from said zone at a temperature in the range from 600°-800° F. (316°-427° C.), the improved method for forming from said effluent a liquid product having a desirably low pour point which comprises:

(a) separating from said effluent a liquid shale oil phase;

(b) lowering the pour point of said liquid phase to less than 40° F. (4.4° C.) by maintaining said liquid phase within said temperature range and below the point of significant thermal decomposition and in the absence of added hydrogen for 1 to 120 minutes, thereby forming said liquid product.

7. The process of claim 6 wherein said oil shale contains at least one of iron and arsenic, said shale oil effluent contains at least one contaminant selected from soluble iron and soluble arsenic, said product has a reduced contaminant content, and in step (b) a precipitate containing at least one of iron and arsenic is formed.

8. In a process for producing shale oil where an oil shale containing at least one of iron and arsenic is retorted in a retorting zone to form a shale oil effluent containing at least one contaminant selected from soluble iron and soluble arsenic, and said effluent is withdrawn from said zone at a temperature in the range from 300°-800° F. (149°-427° C.), the improved method for forming from said effluent a liquid product having a reduced contaminant content which comprises:

(a) separating from said effluent a liquid shale oil phase;

(b) reducing the contaminant content of said liquid phase by maintaining said liquid phase within said temperature range and below the point of significant thermal decomposition and in the absence of added hydrogen for 1 to 120 minutes, thereby forming said liquid product and a precipitate containing at least one of iron and arsenic.

9. The process of claims 7 or 8 including conducting step (b) in the presence of a solid contact material and depositing at least a portion of said precipitate upon said material.

* * * * *